US006846561B1

(12) United States Patent
Gownder et al.

(10) Patent No.: US 6,846,561 B1
(45) Date of Patent: Jan. 25, 2005

(54) BICOMPONENT FIBERS OF ISOTACTIC AND SYNDIOTACTIC POLYPROPYLENE

(75) Inventors: Mohan R. Gownder, Austin, TX (US); Michael Musgrave, Houston, TX (US); Jay Nguyen, Pasadena, TX (US)

(73) Assignee: Fina Technology, Inc., Houston, TX (US)

( * ) Notice: Subject to any disclaimer, the term of this patent is extended or adjusted under 35 U.S.C. 154(b) by 0 days.

(21) Appl. No.: 10/635,788

(22) Filed: Aug. 6, 2003

(51) Int. Cl.[7] ..... D01F 8/00
(52) U.S. Cl. ..... 428/370; 428/373; 428/374
(58) Field of Search ..... 428/370, 373, 428/374

(56) References Cited

U.S. PATENT DOCUMENTS

| | | | | |
|---|---|---|---|---|
| 3,258,455 A | | 6/1966 | Natta et al. | 526/169.2 |
| 3,305,538 A | | 2/1967 | Natta et al. | 526/139 |
| 3,364,190 A | | 1/1968 | Emrick | 526/139 |
| 4,794,096 A | | 12/1988 | Ewen | 502/117 |
| 4,795,403 A | | 1/1989 | Heine et al. | 464/77 |
| 4,852,851 A | | 8/1989 | Webster | 251/61.1 |
| 5,155,080 A | | 10/1992 | Elder et al. | 502/152 |
| 5,225,500 A | | 7/1993 | Elder et al. | 526/127 |
| 5,334,677 A | | 8/1994 | Razavi | 526/114 |
| 5,476,914 A | | 12/1995 | Ewen | 526/351 |
| 6,074,590 A | | 6/2000 | Gownder | 264/172.12 |
| 6,395,392 B1 | * | 5/2002 | Gownder | 428/370 |

FOREIGN PATENT DOCUMENTS

JP 05005261 A * 1/1933

OTHER PUBLICATIONS

Derwent No: 1993–055388 JP 05005261A Jan 27 1993.*

* cited by examiner

*Primary Examiner*—Newton Edwards
(74) *Attorney, Agent, or Firm*—Madan, Mossman & Sriram P.C.

(57) ABSTRACT

Bicomponent fibers of isotactic polypropylene and syndiotactic polypropylene, methods of making such fibers and products made thereof are disclosed. Embodiments of the bicomponent fibers can exhibit self-crimp properties and high shrinkage characteristics.

4 Claims, 5 Drawing Sheets

( a ) Side - by - Side

Component 1 Component 2

( b ) Core - Sheath

Component 1 Component 2

BICOMPONENT FIBERS OF ISOTACTIC AND SYNDIOTACTIC POLYPROPYLENE

BACKGROUND OF INVENTION

1. Field of Invention

The present invention generally relates to fibers, methods of making fibers and to products made thereof. More particularly, the present invention relates to polypropylene fibers that can comprise isotactic polypropylene and syndiotactic polypropylene. In another aspect, the invention relates to bicomponent fibers comprising isotactic polypropylene and syndiotactic polypropylene, to methods of making such bicomponent fibers of isotactic polypropylene and syndiotactic polypropylene, and to products made from such bicomponent fibers of isotactic polypropylene and syndiotactic polypropylene.

2. Description of the Related Art

Polypropylene has found employment in a wide variety of applications. Examples of uses include nonwoven fabrics such as spun bonded, melt blown, thermally bonded and carded staple fibers uses for applications such as diaper components and medical fabrics where properties such as bulk and softness are important. Polypropylene fibers have found commercial use in synthetic carpets, geotextiles, textile fabrics and the like. While polypropylene fibers have found wide application as carpet yarns, polypropylene fibers can lack the elasticity and resiliency of other carpet fiber polymers, for example, nylon. When loads such as furniture legs rest on polypropylene carpets for an extended period are removed, they can leave their impression on the carpet in the form of packed carpet fibers. Poor resiliency prevents the packed fibers from returning back to their original configuration, which can be referred to as elastic recovery.

Bicomponent fibers can comprise a first polymer component and a second component, with each component fused to the other along the fiber axis. The first and second components may be configured as core and sheath, side by side, tipped, mocro denier and mixed fibers, and are generally produced utilizing a specially equipped fiber spinning machine. Examples of bicomponent fibers include nylon and polyurethane, and polypropylene and polyethylene copolymers.

Bicomponent fibers of isotactic polypropylene and syndiotactic polypropylene have been disclosed in U.S. Pat. No. 6,074,590, issued Jun. 13, 2000, and in U.S. Pat. No. 6,395,392, issued May 28, 2002, both to Gownder, herein incorporated by reference. Isotactic propylene (iPP) may generally be described as having methyl groups attached to the tertiary carbon atoms of successive monomeric units on the same side of a hypothetical plane through the polymer chain. Syndiotactic polypropylene (sPP) may generally be described as having methyl groups attached on alternating sides of the polymer chain. While various combinations of syndiotactic and isotactic polypropylene have been proposed, there is still a need in the art for improved bicomponent fibers.

SUMMARY OF THE INVENTION

According to one embodiment of the present invention, there is provided a bicomponent fiber having a first component and a second component, wherein the first component and the second component are fused together and wherein the first component comprises isotactic polypropylene homopolymers or ethylene-propylene random copolymers and the second component comprises syndiotactic polypropylene homopolymers or ethylene-propylene random copolymers.

According to another embodiment of the present invention, there is provided a method of making a bicomponent fiber comprising extruding a first fiber component and a second component, then fusing together the first component and the second component, wherein the first component comprises isotactic polypropylene homopolymers or ethylene-propylene random copolymers and the second component comprises syndiotactic polypropylene homopolymers or ethylene-propylene random copolymers.

DETAILED DESCRIPTION OF THE INVENTION

Figure 1:
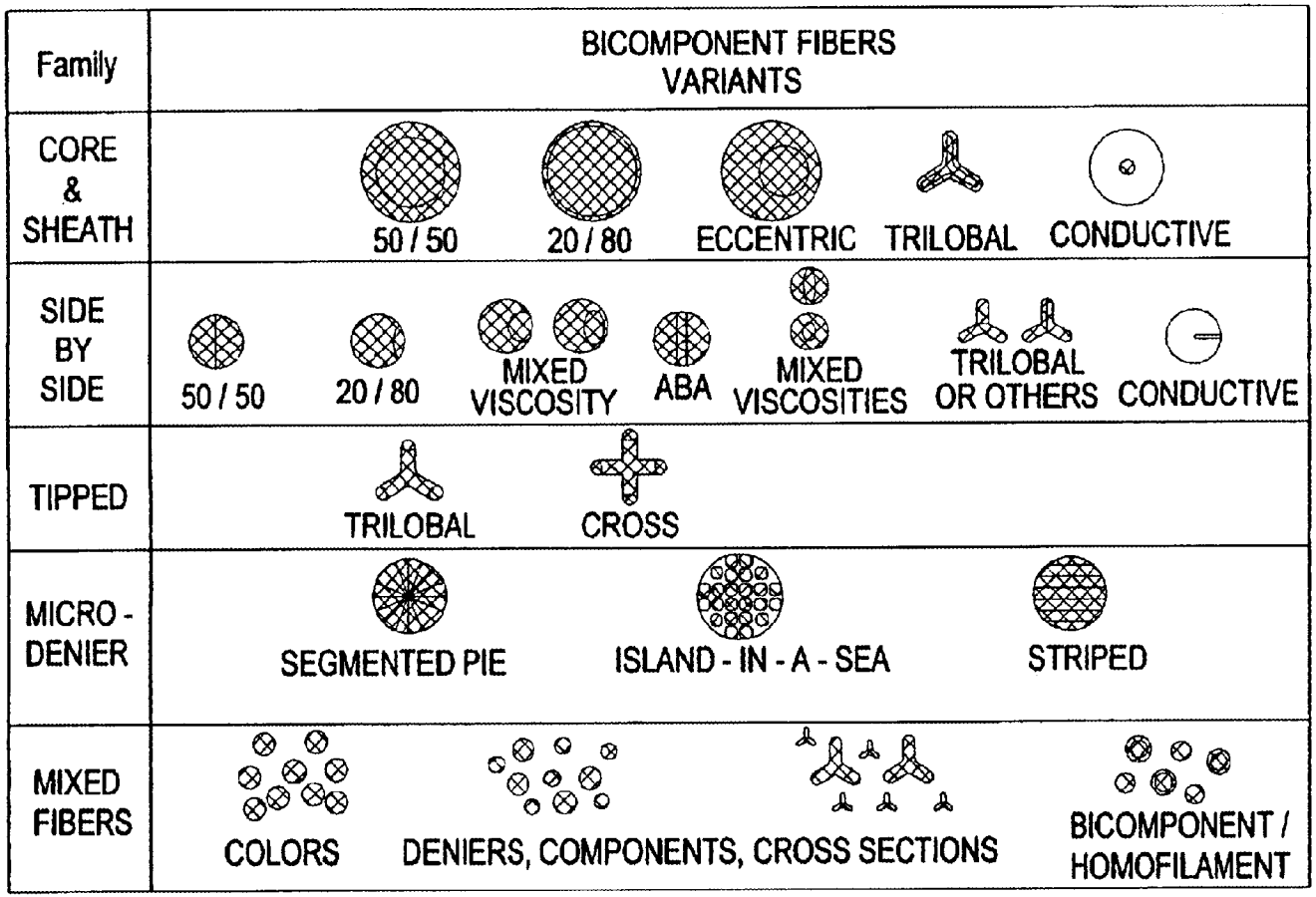
FIG. 1 is an illustration of various types of bicomponent fibers useful in the present invention.

The fibers of the present invention can be bicomponent fibers comprising isotactic polypropylene and syndiotactic polypropylene. The isotactic structure is typically described as having the methyl groups attached to the tertiary carbon atoms of successive monomeric units on the same side of a hypothetical plane through the main chain of the polymer, e.g., the methyl groups are all above or all below the plane. Using the Fischer projection formula, the stereochemical sequence of isotactic polypropylene is described as follows:

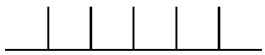

Another way of describing the structure is through the use of NMR spectroscopy. Bovey's NMR nomenclature for an isotactic pentad is . . . mmmm . . . with each "m" representing a "meso" dyad or successive methyl groups on the same side of the plane. As known in the art, any deviation or inversion on the structure of the chain lowers the degree of isotacticity and crystallinity of the polymer.

In contrast to the isotactic structure, syndiotactic polymers are those in which the methyl groups attached to the tertiary carbon atoms of successive monomeric units in the chain lie on alternate sides of the plane of the polymer. Using the Fischer projection formula, the structure of a syndiotactic polymer is designated as:

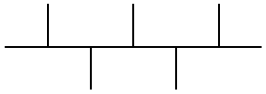

In NMR nomenclature, this pentad is described as . . . rrrr . . . in which each "r" represents a "racemic" dyad, i.e. successive methyl group on alternate sides of the plane. The percentage of r dyads in the chain determines the degree of syndiotacticity of the polymer. Syndiotactic polymers are crystalline and like the isotactic polymers are insoluble in xylene. This crystallinity distinguishes both syndiotactic and isotactic polymers from an atactic polymer which is soluble in xylene.

Suitable isotactic polypropylene utilized in the blends of the present invention and methods of making such isotactic polypropylenes are well known to those of skill in the polyolefin art. Examples of a suitable isotactic polypropylene, methods of and catalysts for their making can be found in U.S. Pat. Nos. 4,794,096 and 4,975,403 hereby incorporated by reference.

The isotactic polypropylene utilized in the present invention can comprise at least 80 percent isotactic molecules. In other embodiments the isotactic polypropylene utilized in the present invention comprises at least 85 person isotactic molecules, or at least 90 percent isotactic molecules and it can be desirable to have at least about 95 percent isotactic molecules. In some embodiments the isotactic polypropylene utilized in the present invention comprises substantially all isotactic molecules.

In alternate embodiments of the present invention the isotactic polypropylenes utilized generally comprise in the range of about 80 to about 90 percent isotactic molecules, in the range of about 90 to about 99 percent isotactic molecules, and desirably in the range of about 95 to about 98 percent isotactic molecules.

The isotactic polypropylenes utilized in the present invention generally have a melt flow rate "MFR" in the range of about 3 to about 2000 dg/min with a 2.16 Kg load at 230° C. For use in the woven and non-woven applications, the isotactic polypropylenes can have a melt flow rate in the range of about 4 to about 40 dg/min, and it may be desirable to be in the range of about 4 to about 37 dg/min. For use in the carded staple fiber, spunbond and meltblown non-woven applications, the isotactic polypropylenes can have a melt flow rate in the range of about 4 to 2000 dg/min. Carded staple fiber applications can have a MFR ranging from about 4 to about 25 dg/min. Spunbond applications can have a MFR ranging from about 4 to about 60 dg/min, and meltblown applications can have a MFR ranging from about 50 to about 2000 dg/min.

The syndiotactic polypropylenes suitable for use in the blends of the present invention and methods of making such syndiotactic polypropylenes are well know to those of skill in the polyolefin art. Examples of suitable syndiotactic polypropylenes, methods of and catalysts for their making can be found in U.S. Pat. Nos. 3,258,455, 3,305,538, 3,364,190, 4,852,851, 5,155,080, 5,225,500, 5,334,677 and 5,476,914, all herein incorporated by reference.

The syndiotactic polypropylene utilized in the present invention can comprise at least 70 percent syndiotactic molecules. In alternate embodiments of the invention the syndiotactic polypropylene utilized in the present invention comprises at least 75 percent syndiotactic molecules, at least 80 percent syndiotactic molecules and at least about 83 percent syndiotactic molecules. It can be desirable to have the syndiotactic polypropylene utilized in the present invention comprising substantially all syndiotactic molecules.

In alternate embodiments of the invention the syndiotactic polypropylenes utilized generally comprise in the range of about 83 to about 95 percent syndiotactic molecules, in the range of about 85 to about 95 percent syndiotactic molecules and it may be desirable to be in the range of about 89 to about 95 percent syndiotactic molecules.

The syndiotactic polypropylenes utilized in the present invention generally have a melt flow rate in the range of about 4 to about 2000 dg/min. For use in some woven applications, the syndiotactic polypropylenes can have a melt flow rate in the range of about 4 to about 40 dg/min, and it can be desirable for the MFR to be in the range of about 4 to about 30 dg/min. For use in some non-woven applications, the syndiotactic polypropylenes can have a melt flow rate in the range of about 30 to about 2000 dg/min.

Examples of commercially available syndiotactic polypropylene homopolymers are polymers known as Fina EOD 93-06 and Fina EOD 93-07 and polymers sold under the trademark FINAPLAS, all of which are available from Atofina Petrochemicals of LaPorte, Tex.

The bicomponent fibers of the present invention can comprise an isotactic polypropylene component and a syndiotactic polypropylene component with each component fused to the other along the fiber axis. The bicomponent fibers of the present invention may be any type of bicomponent fiber. Non-limiting examples of bicomponent fibers that may be utilized in the present invention include various embodiments of side-by-side fibers. Referring to FIG. 1, there is shown non-limiting examples of bicomponent fiber useful in the present invention.

The first component of the bicomponent fiber of the present invention will generally comprise in the range of about 20 to about 80 weight percent of the fiber. The second component will generally comprise in the range of about 80 to 20 weight percent of the fiber based on the weight of the first component and the second component.

Where fiber shrinkage is desired, it can be desirable to utilize fibers having iPP/sPP components in the side/side arrangement. For example, fibers of such iPP/sPP components in a side/side arrangement with iPP/sPP of a 1:1 ratio by volume showed a high shrinkage of 78%. In comparison, commercially available high shrinkage fibers are known to exhibit in the range of about 35–50% shrinkage. The shrinkage of bicomponent fibers can be increased or decreased by adding more or less of sPP, respectively. Possible end use applications for this high shrinkage fiber can include a textile material, a carpet material, a diaper, a feminine hygiene product, a drape, a gown, a mask, a glove, or an absorbent pad. The components can comprise differing physical characteristics that can alter the appearance of the article or application, such as for example, each of the components comprise a different color, thereby blending the two colors throughout a carpet material by way of each individual fiber.

The high-shrinkage iPP/sPP fibers can be used as a replacement for acrylic fibers in many end uses including carpets, woven and non-woven fabrics. The bicomponent fiber can be blended at a level of 30–50% with the standard product. On exposure to a heat source, such as heated water or air, the high-bulk bicomponent fibers shrink so that bulk is developed in the standard, non-shrinkable portion of the carpet. Typically the heat source will be at least 100° C., and can be at temperatures of at least 120° C. It may be desirable to have the heat source between 110° C. and 150° C.

The heat source can be a variety of means such as, for example, heated air, steam, heated drums, etc. The temperature of the heat source is related to 1) the heat transfer coefficient of the heating medium (air, water, steam), 2) the diameter of the fibers, 3) the residence time during which the fiber is heated, and 4) the relative melting points for the two materials of the bicomponent fibers. The melting points of the materials can vary, for example, sPP can range from about 110° C. to about 130° C., (such as 11° C. & 128° C.) versus iPP that can range from about 160 to 166° C. The bulk temperature of the fibers can be used as a process control parameter. It is desirable to keep the bulk temperature of the fibers below the melting point of the iPP component, for example less than 163° C. or in alternate embodiments less than 160° C., less than 150° C., or less than 140° C.

The components of a bicomponent fiber can be joined in a symmetric or asymmetric arrangement. Generally, the spinning of bicomponent fibers involves coextrusion of two different polymers to form several single filaments. Bicomponent fiber extrusion equipment can be utilized to bring together the two component melt streams in a desired predetermined arrangement. Such bicomponent fiber extrusion equipment is known in the art.

Figure 2A:
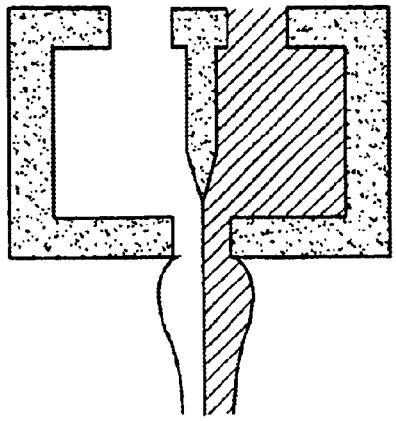
FIGS. 2A and 2B is an illustration of manifolds used for merging of the components in the side-by-side and core-sheath arrangement respectively.
Figure 2B:
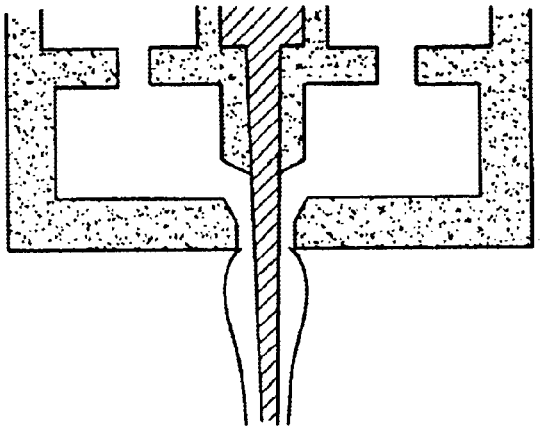

Referring to FIGS. 2A and 2B, there is shown examples of manifolds used for merging of the components in the side-by-side and core-sheath arrangement respectively. The shape of the line between the two components can be controlled by adjusting the separating element into the manifold in relation to the spinnerette hole. The ratio of the components in the fiber can be adjusted by controlling the speed of the metering pump for each component. The spin manifolds used for bicomponent spinning are more complicated than those used for one component spinning and are well known in the art.

Figure 3:
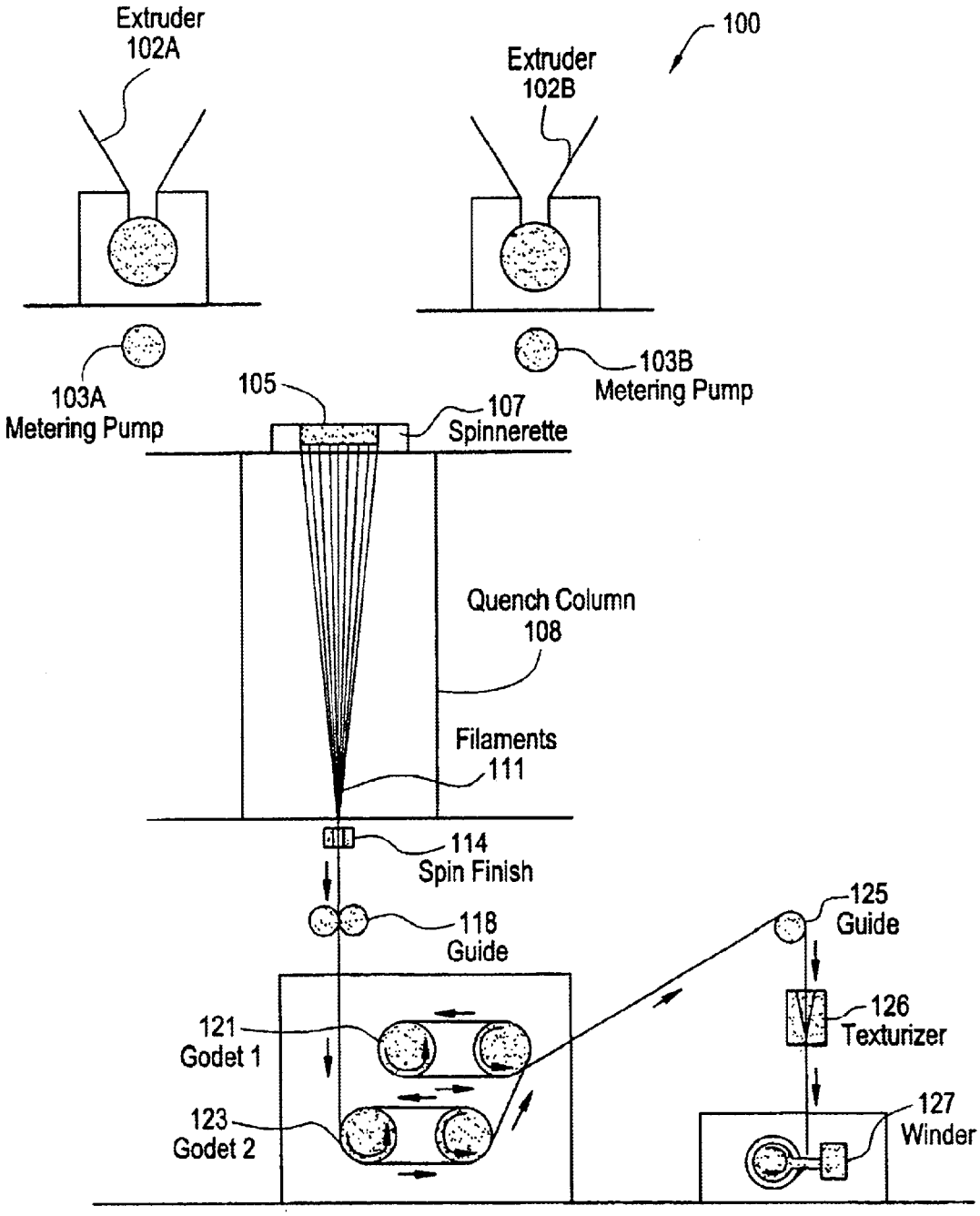
FIG. 3 is a schematic representation of a fiber spinning machine 100.

Referring now to FIG. 3, there is shown a schematic representation of a fiber spinning machine 100. Fiber spinning machines are well known in the art, the present invention is not meant to be limited to any particularly fiber spinning machine. As is shown in FIG. 3, two different polymers are melted in two separate extruders 102A and 102B before being pumped through separate metering pumps 103A and 103B before being pumped into bicomponent spinning manifold 105. The filaments 111 are then formed by passage through spinnerette 107 and solidified by passage through quench column 108. Filaments 111 then travel through a spin finish 114, through a guide 118, over godets 121 and 122, past a guide 123, through a texturizer 126 and onto a winder 127.

The fibers of the present invention are believed to be useful as substitutes for prior art fibers. Non-limiting examples of suitable applications include carpets, geotextiles and both woven and nonwoven fabrics.

The fibers of the present invention may optionally also contain conventional ingredients as are known to those of skill in the art. Non-limiting examples of such conventional ingredients include antiblocking agents, antistatic agents, antioxidants, blowing agents, crystallization aids, colorants, dyes, flame retardants, fillers, impact modifiers, mold release agents, oils, other polymers, pigments, processing agents, reinforcing agents, stabilizers, UV resistance agents, antifogging agents, wetting agents and the like.

EXAMPLES

The following examples are provided merely to illustrate the present invention and not intended to limit the claim of the invention.

Example 1

Figure 4:
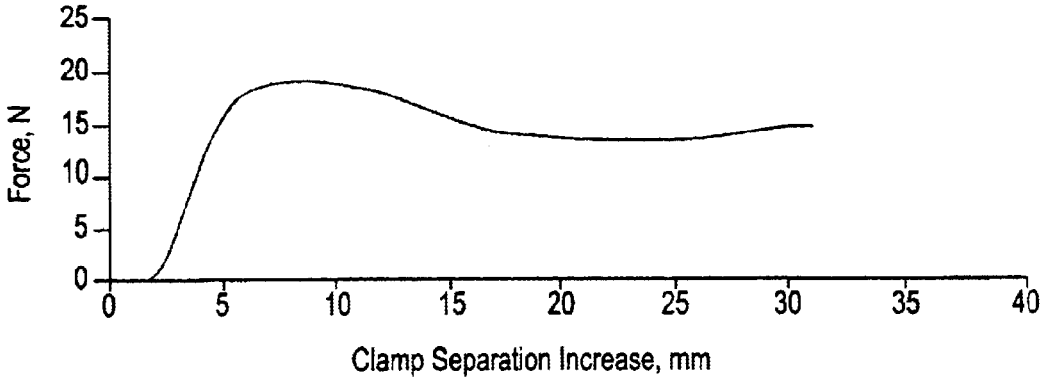
FIG. 4 is a graph of results for Example 1 for five samples carried out at a sealing temperature of 130° C.

To test the adhesion between two polymers, iPP and sPP, film samples of both the polymers are sealed in a Theller Heatsealing System and separated by clamping each end of the film at a rate of 30 cm/min. The force response is an indication of the bonding between the two polymers. Results are shown in FIG. 4 for five samples carried out at a sealing temperature of 130° C. The pairs did not peal off from the seal. The average maximum force was calculated as 21 N.

Example 2

Figure 5:
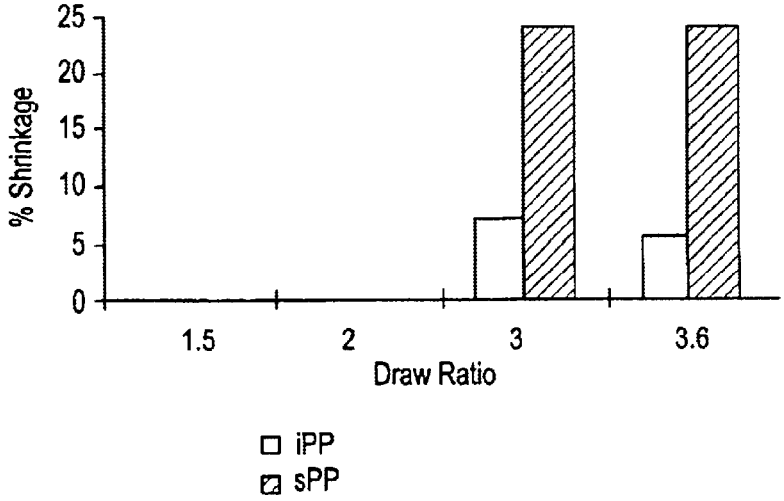
FIG. 5 is a graph of results for Example 2 showing shrinkage characteristics of polymers at 130° C. at draw ratios of 3 and 3.6.
Figure 6:
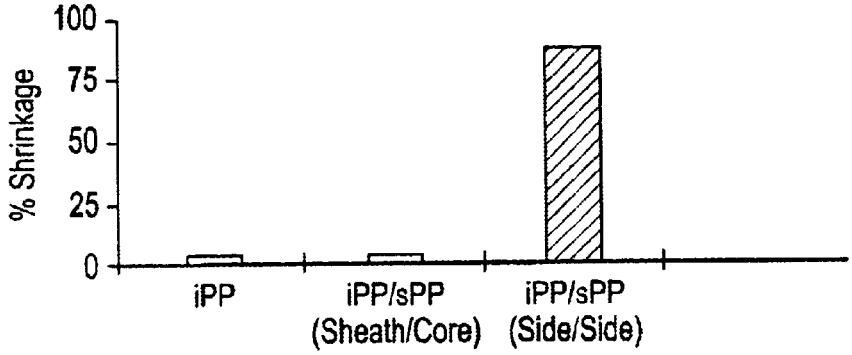
FIG. 6 is a graph of results for Example 3 showing shrinkage characteristics of polymers for (1) iPP fibers, (2) iPP/sPP fibers in the sheath/core arrangement and (3) iPP/sPP in the side/side arrangement.

Shrinkage tests were performed on the sPP and iPP fibers produced individually. FIG. 5 shows shrinkage characteristics of the two polymers at 130° C. at draw ratios of 3 and 3.6. The difference in shrinkage characteristics of the iPP and sPP fiber will allow for crimping of the fiber. This crimping of the fiber can be referred to as self-crimping or auto-crimping. For example, if a bicomponent fiber is produced with sPP and iPP in a side by side arrangement, then sPP with its high shrinkage will tend to pull the iPP in turn, enhancing the crimp of the fiber.

Example 3

This example compares shrinkage data for (1) iPP fibers, (2) iPP/sPP fibers in the sheath/core arrangement and (3) iPP/sPP in the side/side arrangement. The first two fibers show very low shrinkage, whereas the third fiber prepared with iPP/sPP of 50/50 by volume showed a high shrinkage of 78%. In comparison, commercially available high shrinkage fibers exhibit 30–50% shrinkage. The shrinkage of bicomponent fibers can be increased or decreased by adding more or less of sPP respectively. Results are provided below in Table 1.

The fiber was drawn to 3:1 ratio after 2 days from the day it was spun. There were no special process treatments necessary to produce these high shrinkage fibers.

TABLE 1

Linear Skein Shrinkage Data

| Fiber | Linear Skein Shrinkage (%) |
|---|---|
| IPP | 1.3 |
| iPP/sPP (sheath/core) | 1.3 |
| iPP/sPP (side/side) | 78 |

While the illustrative embodiments of the invention have been described with particularity, it will be understood that various other modifications will be apparent to and can be readily made by those skilled in the art without departing from the scope of the invention. Accordingly, it is not intended that the scope of the claims appended hereto be limited to the examples and descriptions set forth within the application.

What is claimed is:

1. A fiber comprising at least 20 wt % of a bicomponent fiber of iPP and sPP monomers or comonomers, the bicomponent fiber being in a side-by-side arrangement, wherein the bicomponent fiber exhibits shrinkage upon exposure to a beat source resulting in an increase in bulk for the fiber.

2. The fiber of claim 1 wherein the fiber is a carpet fiber or a fabric fiber.

3. The fiber of claim 1 wherein the bicomponent fiber comprises between about 30 to about 50 wt % of the fiber.

4. The fiber of claim 1 for forming an article selected from the group consisting of textile materials, carpet face yarns and backing materials, upholstery fabrics, wallcoverings, thermal and acoustical insulation, roofing materials and geotextiles, diaper coverstock and related diaper components, hygiene-related fabrics, medical and surgical wraps, drapes, and gowns and protective clothing, filtration media, wipes and absorbent pads.

* * * * *